US005123890A

United States Patent [19]

Green, Jr.

[11] Patent Number: 5,123,890

[45] Date of Patent: Jun. 23, 1992

[54] APPARATUS AND METHOD FOR SEPARATING FORMS IN A STACK

[75] Inventor: Robert L. Green, Jr., Hillsboro, Ohio

[73] Assignee: G. Fordyce Company, Hillsboro, Ohio

[21] Appl. No.: 501,618

[22] Filed: Mar. 29, 1990

[51] Int. Cl.[5] ..... B41F 13/58

[52] U.S. Cl. ..... 493/357; 493/11; 493/22; 493/411; 493/414; 493/415; 270/21.1; 270/95

[58] Field of Search ..... 493/11, 22, 413, 356, 493/357, 364–365, 463, 411, 414, 415, 28, 480; 83/18, 29, 92; 270/21.1, 39, 95; 198/836.2; 226/76, 84, 85, 86

[56] References Cited

U.S. PATENT DOCUMENTS

| | | | |
|---|---|---|---|
| 992,473 | 5/1911 | Barber | 493/357 X |
| 1,024,459 | 4/1912 | Seymour | 493/357 |
| 1,858,073 | 5/1932 | Cole . | |
| 2,214,593 | 9/1940 | Mustin et al. . | |
| 2,411,075 | 11/1946 | Wyrick . | |
| 2,675,747 | 4/1954 | Greiner et al. . | |
| 2,936,815 | 5/1960 | Schjeldahl et al. . | |
| 3,048,389 | 8/1962 | Salmon et al. . | |
| 3,301,111 | 1/1967 | Nystrand . | |
| 3,589,709 | 6/1971 | Hey et al. . | |
| 3,627,304 | 12/1971 | Reeder et al. | 493/406 X |
| 3,640,521 | 2/1972 | Hutley . | |
| 3,684,275 | 8/1972 | Schweitzer et al. . | |
| 3,724,838 | 4/1973 | Orlovsky . | |
| 3,746,142 | 7/1973 | Hepp et al. | 226/84 X |
| 3,820,700 | 6/1974 | Quiriner . | |
| 3,858,476 | 1/1975 | DeLigt | 493/357 |
| 3,897,051 | 7/1975 | Müller | 493/356 |
| 3,913,904 | 10/1975 | Occhetti . | |
| 3,937,452 | 2/1976 | Gath . | |
| 3,991,993 | 11/1976 | Clouthier . | |
| 4,068,566 | 1/1978 | Joice . | |
| 4,118,022 | 10/1978 | Rayfield et al. . | |
| 4,134,559 | 1/1979 | Dyllus et al. . | |
| 4,190,242 | 2/1980 | Bolza-Schunemann . | |
| 4,205,836 | 6/1980 | Nystrand . | |
| 4,216,497 | 8/1980 | Boetter et al. . | |
| 4,216,705 | 8/1980 | Achelpohl et al. . | |
| 4,223,882 | 9/1980 | Stocker . | |
| 4,269,401 | 5/1981 | Sargis et al. | 271/188 |
| 4,296,684 | 10/1981 | Wangermann . | |
| 4,401,428 | 8/1983 | Thomas et al. . | |
| 4,406,650 | 9/1983 | Felix . | |
| 4,412,637 | 11/1983 | Berger | 226/76 X |
| 4,460,350 | 7/1984 | Mittal et al. . | |
| 4,487,645 | 12/1984 | Weston | 281/5 |
| 4,507,109 | 3/1985 | Meschi . | |
| 4,508,527 | 4/1985 | Uno et al. . | |
| 4,557,789 | 3/1986 | Hofmann et al. . | |
| 4,573,409 | 3/1986 | Clar et al. | 281/5 |
| 4,573,670 | 3/1986 | Felix . | |
| 4,578,052 | 3/1986 | Engel et al. . | |
| 4,593,893 | 6/1986 | Suter . | |
| 4,610,649 | 9/1986 | Friess . | |
| 4,618,340 | 10/1986 | Meschi . | |
| 4,650,447 | 3/1987 | Meschi . | |
| 4,673,382 | 6/1987 | Buck et al. . | |
| 4,688,708 | 8/1987 | Irvine et al. . | |
| 4,702,135 | 10/1987 | Kwansnitza . | |
| 4,708,332 | 11/1987 | Besemann . | |
| 4,718,654 | 1/1988 | Ehlers . | |
| 4,721,295 | 1/1988 | Hathaway . | |
| 4,725,051 | 2/1988 | Parr . | |
| 4,729,812 | 3/1988 | Meschi . | |
| 4,730,762 | 3/1988 | Felix | 83/92 |
| 4,751,879 | 6/1988 | Van Pelt | 493/411 |
| 4,781,090 | 11/1988 | Feldkamper et al. . | |
| 4,842,572 | 6/1989 | Roth . | |
| 4,846,454 | 7/1989 | Parkander | 493/324 |
| 4,928,940 | 5/1990 | Dash | 270/21.1 |

OTHER PUBLICATIONS

Wrap Spring Clutches and Brakes, Warner Electric, pp. 22–23, 45.

YSS Rotary Cutter Unit, Hitachi Metals, Ltd., pp. 1–13.

*Primary Examiner*—Bruce M. Kisliuk

*Assistant Examiner*—John A. Marlott

*Attorney, Agent, or Firm*—Killworth, Gottman, Hagan & Schaeff

[57] ABSTRACT

An apparatus and method in which a rotary cutter is disposed upstream from a folder so that a continuous web received from a high speed printer is first severed with transverse cut lines located along or offset from perforated lines in the continuous web, and then folded. When transverse cut lines offset from perforated lines are made, a tail is formed between the transverse cut line and adjacent perforated line which may be used to facilitate identification and separation of the folded forms from others in a stack.

10 Claims, 6 Drawing Sheets

APPARATUS AND METHOD FOR SEPARATING FORMS IN A STACK

BACKGROUND OF THE INVENTION

The present invention relates to an apparatus and method for separating and folding sections of a continuous web, in particular, to cutting and then folding multi-page forms in response to indicia on a continuous web. The present invention further relates, in particular, to cutting a continuous web slightly offset from a perforated or weakened line of folding to produce a tail or tab for each form which can be used to identify and separate the folded form from a stack.

The development of high speed printers has been accompanied by the need for improved devices to separate sections of continuous webs containing forms, printouts and reports. Multi-page web sections, forms, printouts, reports and the like are, as a group, referred to herein as forms, and a page is defined as extending between adjacent perforated or weakened lines of folding in a form or continuous web. Known devices typically burst or sever perforated or weakened lines of folding (hereafter, perforated lines) in a continuous web, and are suitable for separating continuous webs or a number of connected forms into stacks. The individual forms in each stack must thereafter be separated by hand.

Bursting devices, such as that disclosed by Irvine et al, U.S. Pat. No. 4,688,708, typically interrupt the progress of the continuous web to effect bursting. The speed of bursting devices remains limited despite improvements. Bursting devices typically find application in separating continuous webs which have been supplied to a printer pre-folded along perforated lines. Pre-folding weakens the perforated lines enabling bursting devices to typically separate forms prior to re-folding. However, the free leading edge of following forms or stacks are not entirely controlled and directed once separation has occurred. Once stacked, the forms in a stack must be identified and separated by hand.

Severing devices typically reciprocate a knife-like blade into a continuous zig-zag folded web at predetermined intervals to sever adjoining stacks along a perforated or weakened line. Typical of such devices is that shown by Uno et al, U.S. Pat. No. 4,508,527. The stack size which is produced is generally limited to a predetermined minimum and maximum number of forms, and separation of individual forms in each stack must, again, be undertaken by hand.

Other devices are known by which continuous webs may be severed transversely to cut single-page forms of predetermined length. Suter, U.S. Pat. No. 4,593,893 discloses transverse cutters which appear to operate in a scissors or guillotine fashion to cut single-page forms from a continuous web. Such cutters typically require interruption in the progress of the web for cutting. Feldkamper et al, U.S. Pat. No. 4,781,090 disclose a rotary cutter for severing single-page sections from a continuous web by transverse cuts in response to printed marks on the web. These severing devices permit successive separation of the web into single-page forms and have been limited to applications where no folding is required. The stacks of forms which result must still be sorted by hand.

Finally, various control systems have been developed to initiate the bursting or severing action of separating devices, such as those disclosed typically by Hoffman et al, U.S. Pat. No. 4,577,789, Meschi U.S. Pat. No. 4,618,340, and Feldkamper et al, wherein sensors detect printed marks or holes on the web and signal the separating device to act in a timed sequence to separate stacks or forms from the web. However, the control system of each separating device appears to vary with its construction and manner of operation.

Known devices can separate forms from a continuous web, however, their speed, versatility and manner of operation limit their usefulness with high speed printers. Many bursting, and scissors or guillotine severing devices require undesirable interruption in the progress of the continuous web. Severing devices with reciprocating blades have limited ability to accommodate the severing of short stacks, while rotary cutters accommodate only the cutting of short or single-page forms. More importantly, regardless of the separating device, individual forms within a stack must be separated and identified by hand.

Accordingly, further improvements are needed to satisfy the demand for more efficient and higher speed devices which can separate consecutive stacks and forms from a continuous web, and which can alleviate the burden of manual separation and sorting of forms in a stack.

SUMMARY OF THE INVENTION

The present invention meets those needs by providing a method and apparatus for use with high seed printers which can sever and then fold multi-page sections of a continuous web, i.e. forms, into a stack. The present invention, as well, can provide a tail for each form to facilitate identifying and sorting folded forms in a stack.

A rotary cutter having a rounded tail blade is located downstream from an infeed roller assembly and pinfeed assembly which feed a foldable, continuous web of paper to the rotary cutter at a generally constant rate from a high speed printer. The rotary cutter, located upstream of a folding apparatus, severs the continuous web with transverse cuts into forms of two or more pages. The transverse cuts may be positioned along or offset from perforated lines in the continuous web. The advantage of placing the rotary cutter upstream from the folding apparatus is that the continuous web may be severed with maximum frequency needed for separating multi-page forms. The advantage of using a rotary cutter having a rounded tail blade is that contact between the tail of the blade and the rapidly moving continuous web may be avoided when the blade is engaged in a cutting rotation to sever the continuous web, thus avoiding jamming of the continuous web.

It has long been recognized that severing a continuous web prior to folding produces control problems with the two loose ends which result, in particular, the leading edge of the continuous web. As well, once forms have been separated from the continuous web, problems exist with both controlling and folding the form. These problems are accentuated where a continuous web advances at high rates from a high speed printer. In the present invention, although severing of the web produces two loose ends and a separated form, control of both the separated form and the leading edge of the continuous web is maintained. Upon severing, the leading edge of the separated form has already been received by an outfeed assembly which, in turn, advances the form to a folding apparatus. Control of the loose trailing end of the separated form, therefore, is maintained. More particularly, in the outfeed assembly, a pull roll and hold-down assembly direct the form through a fixed chute into a pair of outfeed gripper rollers which feed the form into the swing chute of a folding apparatus. Control over the loose, leading edge of the continuous web is maintained by advancing it with the pinfeed assembly past the rotary cutter into the outfeed assembly. The loose, leading edge of the continuous web is retained and controlled initially by the hold-down assembly and pull roll of the outfeed assembly, and then continues, as aforesaid, through the fixed chute and outfeed gripper rollers to the folding apparatus.

The folding apparatus is a dynamic or zig-zag folder which is capable of initiating folding of successive forms which have not been pre-folded, such as those provided on continuous paper rolls, or those which have been pre-folded, such as are provided in box form. The outfeed gripper rollers provide positive direction to forms entering the swing chute of the folding apparatus. As a result, control of the leading edge necessary to repeatedly initiate folding is obtained at the outset. Other aspects of the folder are conventional and control the remainder of the folding and stacking process.

A further aspect of the present invention is presented where transverse cuts are offset slightly from perforated lines and a tail is created between the transverse cut and the perforated line from which it is offset. When a separated form is folded, the tail is sufficiently short to avoid folding and will extend beyond an edge of a stack of folded forms, enabling the end of each form to be easily identified and the form separated from the stack. To enhance identification of folded forms in a stack, the tails thereof may further bear identifying indicia previously printed on the continuous web in the area intended to form the tail.

Another aspect of the present invention involves the manner in which severing by the rotary cutter is initiated in response to indicia on the continuous web. The indicia, such as printed que marks, are sensed by an electro-optical sensor which, in cooperation with a printed logic circuit and a pulse-generating cut position sensor, signals a clutch/brake to engage the rotary cutter and transversely sever the continuous web with one cutting rotation. The clutch/brake repeatably and quickly cycles the rotary cutter through a single rotation back to its initial starting position.

In a further aspect of the present invention, two methods for separating and folding forms in a stack are provided, the first comprising the steps of feeding a continuous web having perforated lines to a rotary cutter; transversely severing the continuous web along transverse cut lines made at perforated lines, in response to indicia on the continuous web, to make forms of two or more pages; advancing the forms from the cutter to a folding apparatus; and folding the forms in a zig zag folder along each perforated line. The method further provides for the step of stacking the folded web sections.

A second, alternative method of the present invention comprises the steps of feeding a continuous web having perforated lines to a rotary cutter; transversely severing the continuous web along transverse cut lines offset from perforated lines to form forms of two or more pages having tails; advancing the forms from the rotary cutter to a folding apparatus; and, folding the forms in the folding apparatus along all perforated lines except that one which is adjacent the transverse cut line forming the tail. The method further provides for the steps of stacking the folded forms so that the tails of each folded form extend beyond an edge of the stack; and separating or identifying the folded forms from the stack by reference to the tails extending from the stack.

A further aspect of the present invention is a method for advancing and controlling a form (or equally, a continuous web) having a loose leading edge, comprising the steps of: advancing a form having a loose leading edge with a pinfeed assembly; engaging the leading edge with a hold-down assembly and pull roller; directing the leading edge and the form through the hold-down assembly and pull roller through a fixed chute into a pair of outfeed gripper rollers; and, gripping the leading edge and form with the outfeed gripper rollers to advance them to a folding apparatus. The method further preferably provides for temporarily imparting a corrugated shape to the form with outfeed gripper rollers. Such corrugation temporarily stiffens the form, to enhance feeding the form into the folding apparatus.

The method of the present invention is adapted for applications involving high speed printers, and does not require interruption in the progress of the continuous web from the printer to achieve the desired step of severing prior to folding. The method, as well, may be adapted for use with other printers. The method and apparatus of the present invention may be used to separate and fold forms from both pre-folded and previously unfolded continuous webs.

Finally, in a further aspect of the present invention, an article is provided comprising a folded form of two or more pages having a tail which may be used to identify the form in a stack.

DETAILED DESCRIPTION OF THE PREFERRED EMBODIMENT

Figures 1, 2:
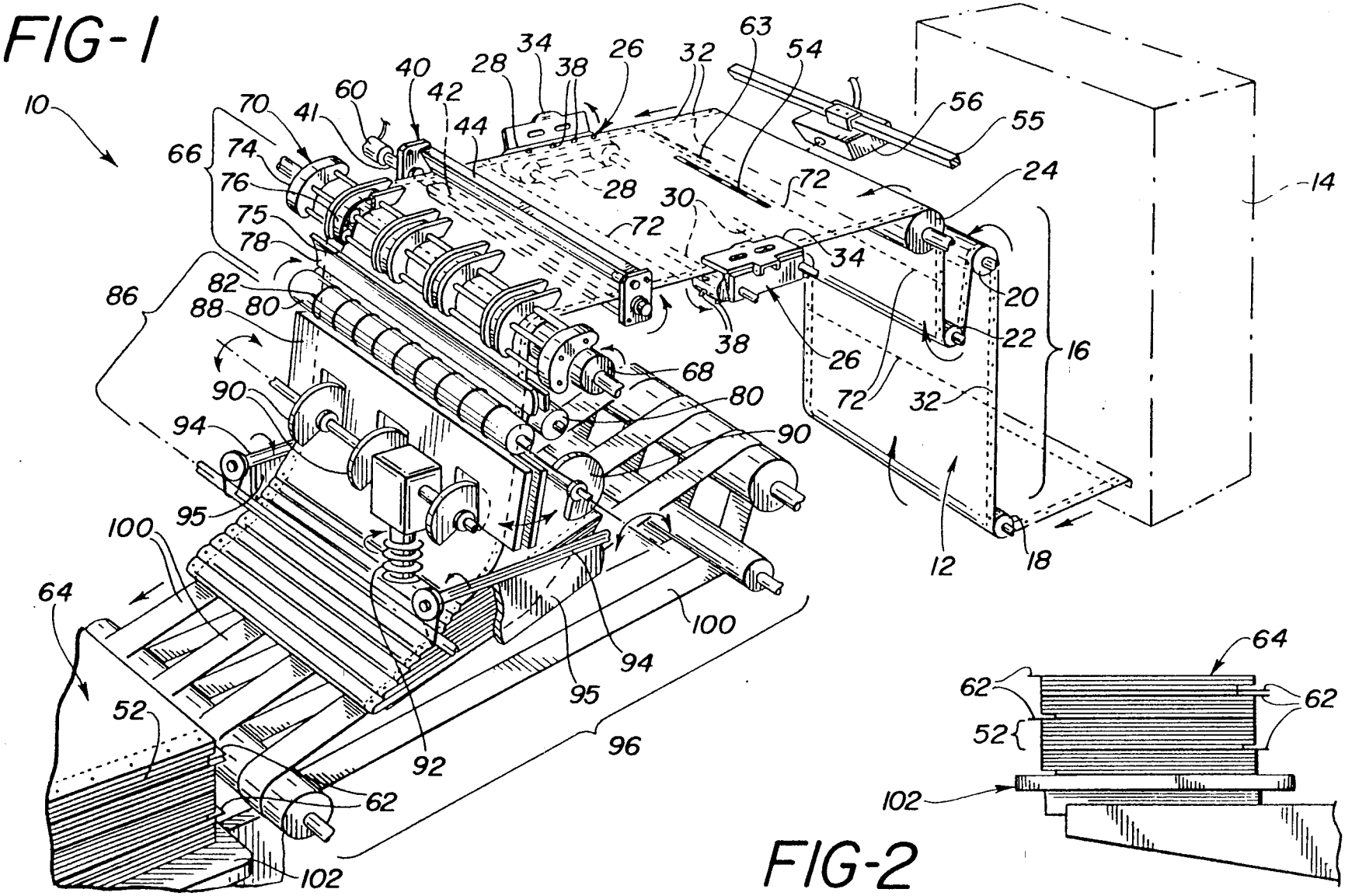
FIG. 1 is a perspective schematic view of the present invention.
FIG. 2 is an elevational view of the stacker table as seen in FIG. 1.
Figure 5:
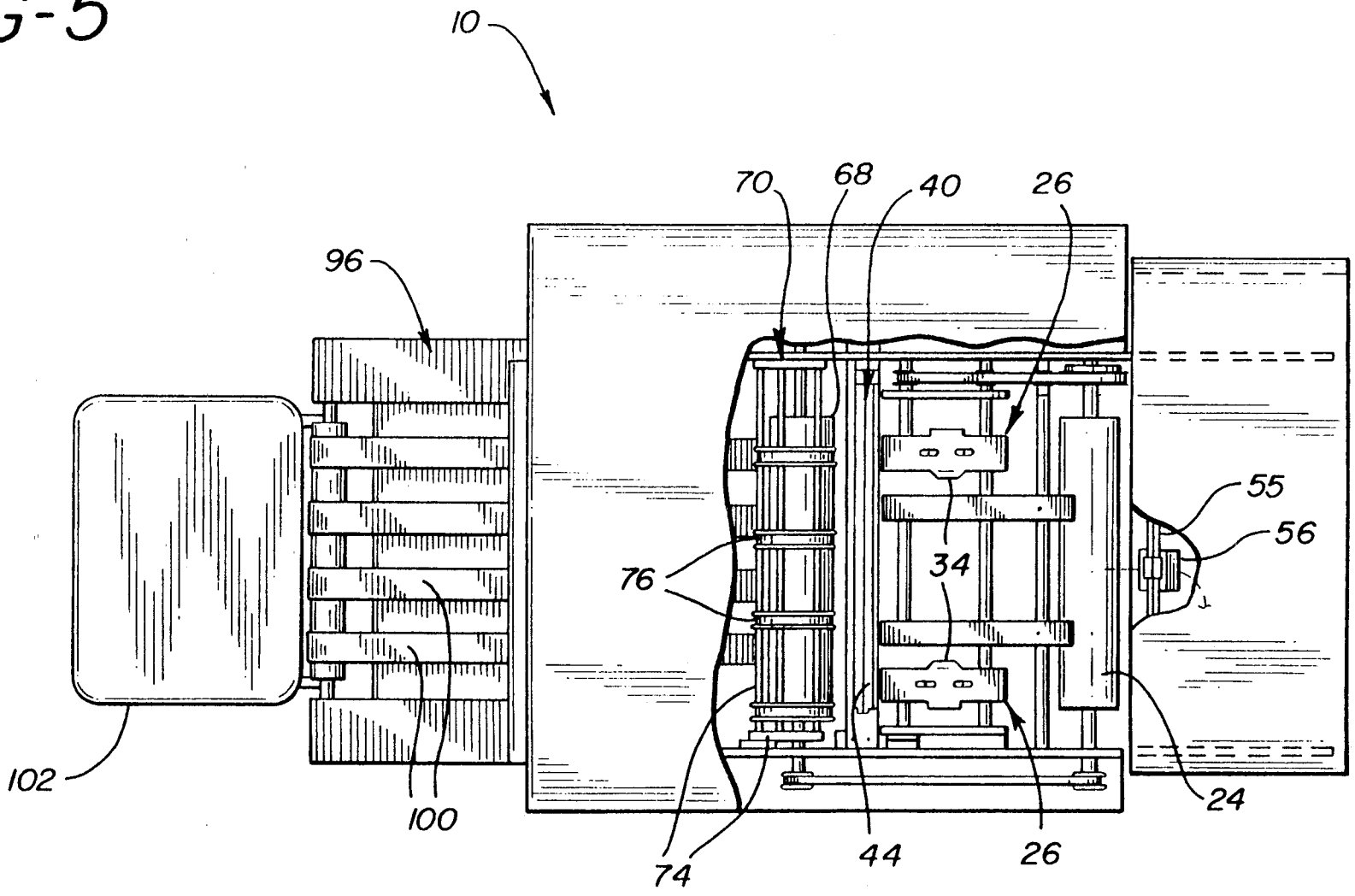
FIG. 5 is a top view of the present invention.

Referring to FIG. 1, in accordance with the present invention, an apparatus 10 for separating and folding forms from a continuous web is shown. FIG. 1 schematically illustrates the relationship and operation of the various elements of the present invention. For simplicity, the supporting structure of apparatus 10 has been omitted from FIG. 1, and is shown representatively in FIGS. 5–7. As shown in FIG. 1, a continuous web 12 output from high speed printer 14 is pulled through infeed roller assembly 16 by pinfeed assemblies 26. Infeed roller assembly 16 is comprised of an idle roller 18, idle guide roller 20, speed dancer roller 22, and infeed roller 24. Idle guide roller 20 includes conventional side guides (not shown) to prevent continuous web 12 from sliding laterally. Speed dancer roller 22 compensates, in a manner known in the art, for minor variations in the speed of continuous web 12 as it is pulled into apparatus 10. Infeed roller 24 is driven by a motor 36 (FIG. 6) and a mechanical transmission 37 (representatively shown, in part, in FIG. 6) at a speed consistent with that of pinfeed assemblies 26. Motor 36 is preferably a direct current (d.c.) motor having a regenerative d.c. drive, and is connected to a source of electrical power (not shown). The various rollers of infeed roller assembly 16 have smooth surfaces and are made of materials known in the art, such as aluminum and stainless steel.

Still referring to FIG. 1, each pinfeed assembly 26 includes a pin-belt 28 having pins 38 which pull continuous web 12 into apparatus 10. Pins 38 are thrust through holes 32 in the margins of continuous web 12 as is known in the art. Pin-belts 28 are rotated in concert by pin-belt axle and drive wheel assemblies 30 driven by motor 36 and mechanical transmission 37 (see FIG. 6). Pinfeed assemblies 26 include top guides 34, shown in open and closed positions, which close over holes 32 to prevent continuous web 12 from wandering off pins 38 during operation. Pinfeed assemblies 26 are also used to initially register continuous web 12 in apparatus 10 along a perforated line 72, and maintain the alignment of continuous web 12 as it is pulled through infeed roller assembly 16.

Figure 3:
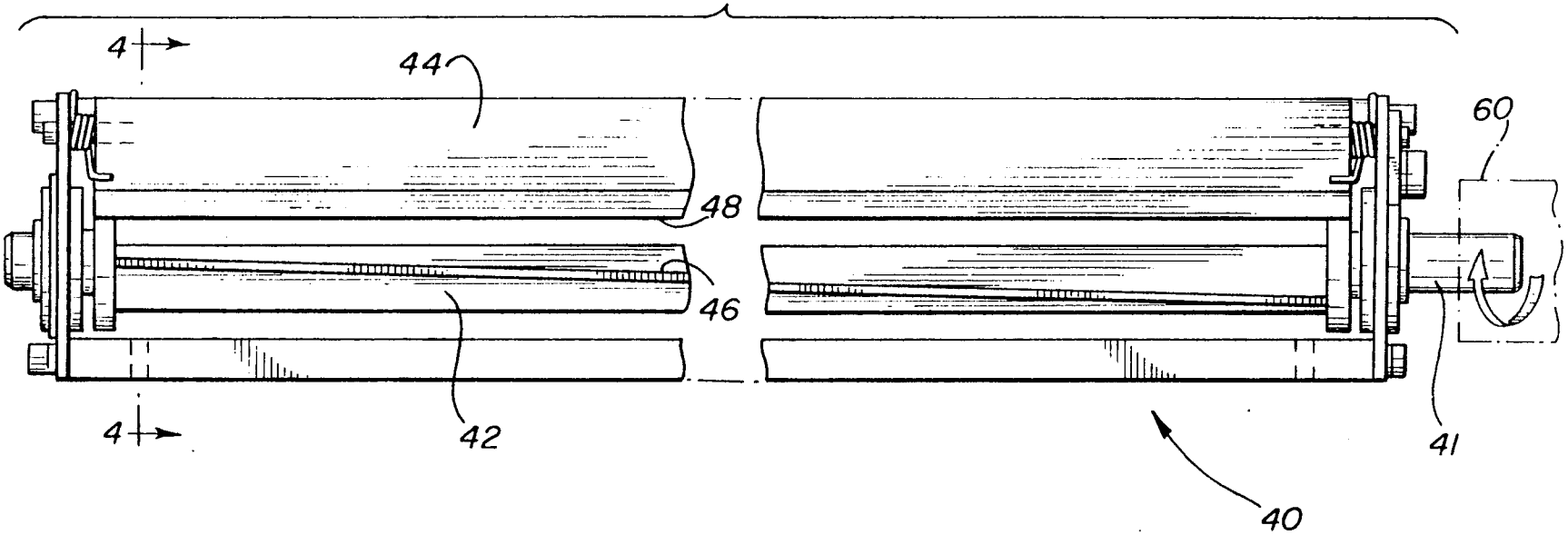
FIG. 3 is a front elevational view of the rotary cutter used in the present invention.
Figure 4:
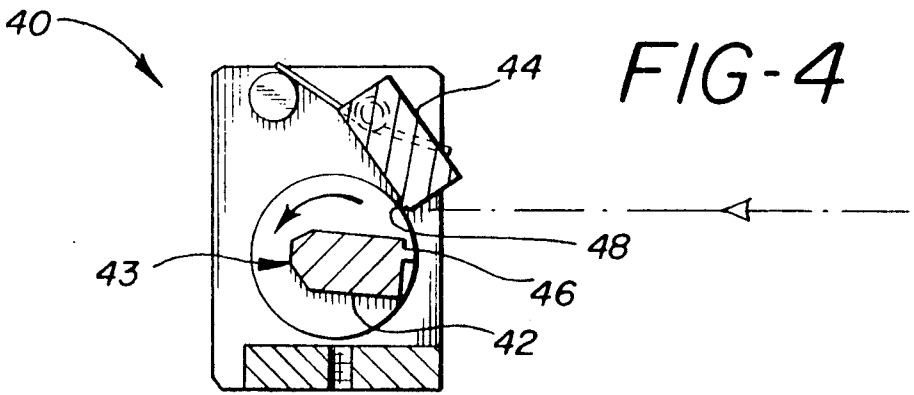
FIG. 4 is a cross-section of the rotary cutter of FIG. 3 at line 4—4.

Pinfeed assemblies 26 advance continuous web 12 into rotary cutter 40 for severing prior to folding. Shown in more detail in FIGS. 3 and 4, rotary cutter 40 includes a rounded tail blade 42 and anvil 44 which each have cutting edges 46 and 48, respectively, made of high speed steel, such as a high carbon high chromium steel. As shown in FIG. 3, cutting edge 46 is designed with a generally helical shape, while cutting edge 48 is generally straight. The rounded tail 43 of rounded tail blade 42, best shown in FIG. 4, results when square corners are removed from the tail of a blade, and may comprise a rounded, or beveled surface, as shown. Rotary cutters 40 such as described are commercially available, for example, from Hitachi, Model No. 962200, and are capable of operating at the high revolutions per minute (rpm), generally in the range of 1110 rpm, as required to accommodate the severing of continuous webs 12 from high speed printers.

Figure 8:
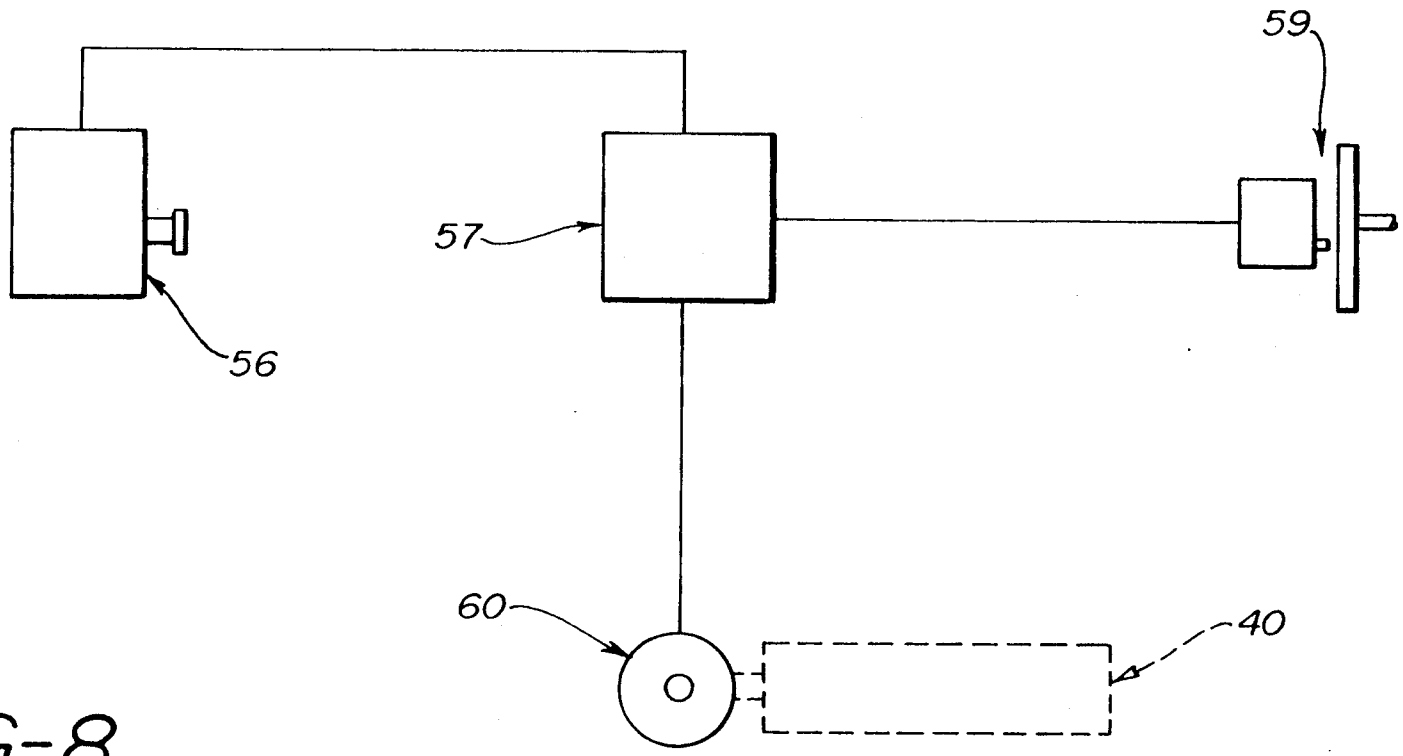
FIG. 8 is a functional diagram of the sensing and operating circuit for the rotary cutter of the present invention.

Referring again to FIG. 1, severing with rotary cutter 40 may be initiated in response to indicia 54, such as printed que marks, on continuous web 12. Indicia 54 indicate the end of a form 52 on continuous web 12. Indicia 54 are sensed by an electro-optical sensor 56. Such electro-optical sensors are known in the art. Sensor 56 is mounted on bar 55, and its position thereon may be varied to sense indicia 54 across the width of continuous web 12. As shown in FIG. 8, sensor 56, upon sensing indicia 54, sends a signal to printed logic circuit 57 which, in response, begins counting pulses from a pulse-generating cut position sensor 59. When the pulse count reaches a predetermined number related to the page size of the continuous web 12, printed logic circuit 57 sends a signal activating the solenoid of clutch/brake 60. Clutch/brake 60 engages rounded tail blade 42, thereby enabling the same to transversely sever continuous web 12 with one cutting rotation. Clutch/brake 60 is coupled to axle 41 (FIG. 3), and when engaged is rotatably driven by a belt communicating with mechanical transmission 37 attached to motor 36. Clutch/brake 60 is a repeatable, single cycle device with rapid engagement, such as that manufactured by Warner Electric, Model #CB-4, having 3 millisecond engagement.

Rotary cutter 40 may, thus, be engaged with the speed necessary to successively sever continuous web 12 with transverse cuts into forms 52 of two or more pages. The transverse cuts may be positioned along or offset from the perforated lines 72 anywhere on continuous web 12. As further discussed below and shown in FIGS. 1 and 2, a tail 62 is created by transversely cutting continuous web 12 offset from perforated lines 72. Tail 62 may be used to identify and separate a folded form 52 from a stack 64. In such cases, the transverse cut is best cut offset ½ inch or less from perforated line 72 to form a tail 62 of ½ inch or less. Tail 62 is preferably ¼ inch wide, on the trailing end of a form 52. A tail 62 on the leading edge of form 52 is possible, but not preferred due to a higher probability of a leading edge tail folding back and jamming in outfeed assembly 66 or folding apparatus 86. To aid in identifying and separating folded forms 52 from a stack 64, identifying indicia 63 may be printed on continuous web 12 in the area in which tail 62 is to be formed. Identifying indicia 63 are shown representatively in FIG. 1, in the area of a trailing end tail 62. Because of the speed of continuous web 12 and the helical shape of cutting edge 46, the transverse cut made in continuous web 12 will be slightly angled as it extends transversely across the width of the form. A correspondingly slight adjustment in the mounting angle of rotary cutter 40 in apparatus 10 can correct this angle if such correction is desired.

Severing of the continuous web 12 at rotary cutter 40 produces two loose ends which must be controlled, the trailing end of separated form 52 and leading edge of continuous web 12. Referring still to FIG. 1, control over the loose, leading edge of continuous web 12 is maintained by advancing it with pinfeed assembly 26 past rotary cutter 40 into outfeed assembly 66, which is located as close as practicable to rotary cutter 40. The loose, leading edge of continuous web 12 is retained initially and controlled by hold-down assembly 70 and pull roller 68 of outfeed assembly 66. Initial contact and retention of continuous web 12 between hold-down assembly 70 and pull roller 68 preferably occurs at the vertical centerline of pull roller 68. From this point, the description of the operation of outfeed assembly 66 and folding apparatus 86 may apply equally to continuous web 12 or form 52. As pull roller 68 rotates, continuous web 12 turns 90 degrees and is directed through fixed chute 78 into a pair of outfeed gripper rollers 80 of the outfeed assembly. Outfeed gripper rollers 80 feed continuous web 12 into folding apparatus 86. Thus, by the time the trailing end of a form 52 is formed by severing continuous web 12, the leading edge of form 52 has already been received by outfeed assembly 66 and is at some point along the path just described.

Figure 6:
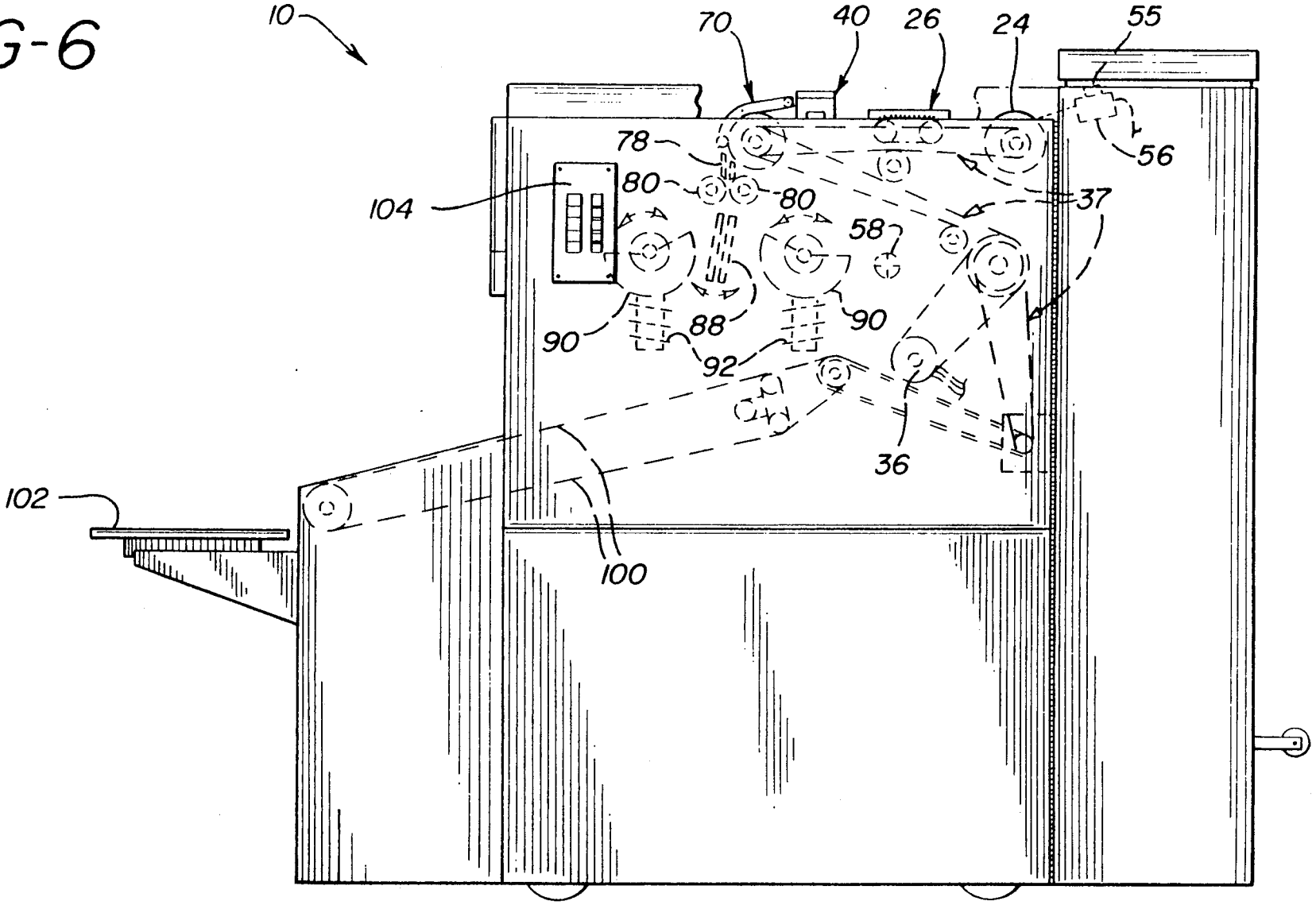
FIG. 6 is a side elevational view of the present invention.
Figure 7:
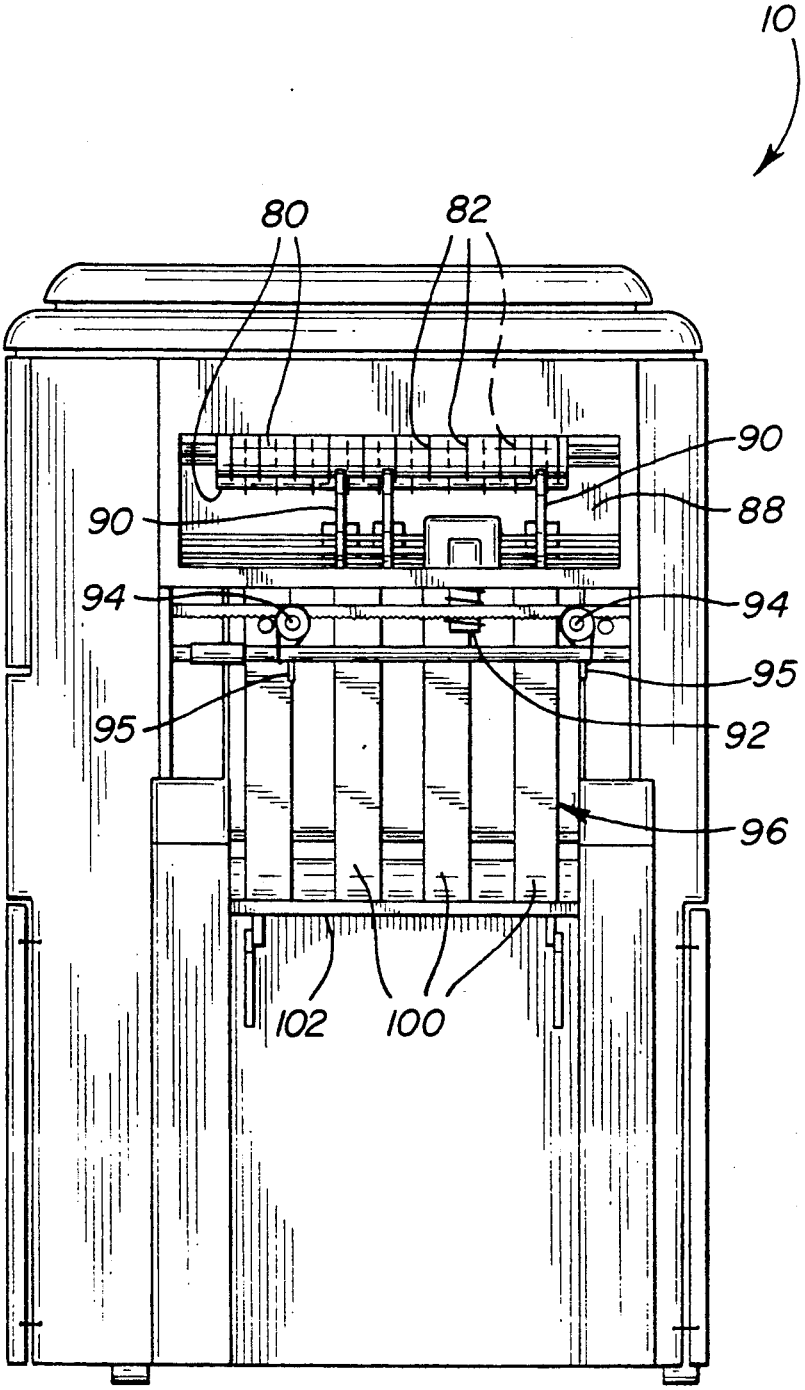
FIG. 7 is an outfeed-end view of the present invention showing portions of the outfeed assembly, folding apparatus, and delivery and stacker table.

Outfeed assembly 66 is best seen in FIGS. 1 and 6. Pull roller 68, preferably comprised of stainless steel with a roughened frictional surface treatment, such as that achieved by spray welding, and is driven by mechanical transmission 37 which is powered by motor 36. Hold-down assembly 70 is comprised of a frame 74 having rotatable toothed gears 75 on which belts 76 rotate passively upon frictional contact with continuous web 12 or form 52. Fixed chute 78, comprised of stainless steel or aluminum, provides control of the leading edge of continuous web 12 or form 52 as it passes into outfeed gripper rollers 80. Outfeed gripper rollers 80 are also driven by mechanical transmission 37 which is powered by motor 36. Outfeed gripper rollers 80 grip and stiffen continuous web 12 or form 52 in preparation for pushing downward into folding apparatus 86. Elastomeric O-rings 82 placed in grooves around outfeed gripper rollers 80 are spaced evenly (generally, 1" apart) across their length in offset relationship, as shown in FIG. 7. Outfeed gripper rollers 80 are spaced apart sufficiently that, in cross-section, the outside diameters of O-rings 82 slightly overlap, but do not approach contact with the opposing outfeed-gripper roll 80. As a result, outfeed gripper rollers 80 impart a corrugating effect to continuous web 12 or form 52 which, in addition to frictional contact with O-rings 82, enhances control and positive feed of continuous web 12 or form 52 into folding apparatus 86.

Pull roller 68 and outfeed gripper rollers 80 of outfeed assembly 66 are both driven slightly overspeed relative to pinfeed assembly 26 to ensure separation of severed forms 52 from continuous web 12, and avoid jamming.

Folding apparatus 86, of the dynamic or zig-zag type, initiates folding of successive forms 52 fed from outfeed gripper rollers 80. Folding apparatus 86 is typical of variable size folders commercially available from G.Fordyce Co., Inc. With reference to FIGS. 1, 6 and 7, forms 52 entering swing chute 88 emerge as swing chute 88 approaches an end point of the arc in which it swings. The leading edge and subsequent perforated lines 72 of continuous web 12 or form 52 are urged towards spirals 92 by knockdown fingers 90. Spirals 92 and knockdown fingers 90 initiate folding and control front to back motion of forms 52. Spirals 92, rotating as indicated in FIG. 1, urge the pages of forms 52 to fold downward along perforated lines 72. Fluted rollers 94, rotating as shown in FIG. 1, contact the edges of folded forms 52 both urging them to fold and to compact into box 95. Box 95 is comprised of side walls, as shown in FIG. 1. Box 95 and fluted rollers 94 control side to side motion of both forms 52, and stack 64 of forms 52, building on the delivery table 96. Delivery table 96 is preferably at substantially a 15% tilt, and belts 100 thereof move from 0.0 to generally 1.5 feet per minute towards stacker table 102, where vertical stacks 52 may be formed. Stack 64 is shown in FIGS. 1 and 2 for purposes of illustration, and would ordinarily stack continuously on stacker table 102 from delivery table 96. Stacker table 102 can be raised and lowered by conventional means, including automatically lowering in response a weight sensor at a speed relative to the speed of belts 100 on delivery table 96, and raising stacker table 102 with an auxiliary motor.

Other aspects of the frame, supports, mounts, connecting means, and materials used to manufacture, connect and operate apparatus 10 are conventional. Mechanical transmission 37, partially and representatively shown in FIG. 6, is a combination of gears, shafts, pulleys and belts as are known in the art for transmitting mechanical power from the shaft of an electric motor, e.g. motor 36, powered by a source of electricity (not shown), to the various driven elements referred to throughout. Control panel 104, shown in FIG. 6, is a conventional push button panel for controlling the operation of apparatus 10.

In operation, apparatus 10 may be adjusted to accommodate pages from 6 inches to 16 inches wide, and from 6 inches to $14\frac{7}{8}$ inches long (perforated line 72 to adjacent perforated line 72). Forms 52 of two or more pages may be separated from continuous web 12 and folded, however, three or more pages are preferred. Apparatus 10 is adapted to separate and fold forms 52 from prefolded or previously unfolded continuous webs 12. A continuous web 12, having pages with intermediate transverse perforations spaced between perforated lines of folding 72, can also be separated and folded without separating or folding such intermediate transverse perforations.

The maximum speed of high speed laser printers, such as the IBM 3800, is currently substantially 160 to 165 feet per minute (fpm). While the capacity of the folding apparatus 86 may exceed 500 fpm, the present invention preferably operates substantially up to 200 fpm, as is necessary to meet current printer speeds. The speed of motor 36, and correspondingly the various driven elements, is adjusted to accommodate the output rate of printer 14 by way of signals to a control circuit (not shown) from a potentiometer (not shown) which measures the position of speed dancer roller 22.

Initial registration of continuous web 12 in apparatus 10 is made with reference to a score line (not shown) which may be established on top guides 34 of pinfeed assemblies 26. A timing indicator 58 (shown in FIG. 6) may be included to permit adjusting the operation of folding apparatus 86 to accommodate different sized pages, and such adjustment may be coordinated with a change of gears in mechanical transmission 37 in a manner known in the art.

Finally, the position of the transverse cut made by rotary cutter 40 may be finely adjusted by changing the position of a pulse-generating cut position sensor 59 (see FIG. 8). Cut position sensor 59 is comprised of a diffused scan optical fiber sensor, an amplifier, and an indicating wheel which travels rotatably a given distance corresponding to the rotation of infeed roller 24 and the page size. The diffused scan optical fiber sensor generates pulses as the indicating wheel, which has a radial slot, rotates. The position of the diffused scan optical fiber sensor may be adjusted to change the timing of pulses generated, thereby delaying or advancing the pulse signals and the resulting activating signal from printed logic circuit 57 which engages rotary cutter 40.

A further aspect of the present invention is a method for separating and folding forms 52 in a stack 64, which comprises the steps of: feeding a continuous web having perforated lines 72 to a rotary cutter 40; transversely severing the continuous web 12 along transverse cut lines made at perforated lines 72, in response to indicia 54 on the continuous web 12, to make forms 52 of two or more pages; advancing the forms 52 from the rotary cutter 40 to a folding apparatus 86; zig zag folding the forms 52 in a folding apparatus 86 along each perforated line 72; and stacking the folded forms 52.

An alternative method of the present invention provides for the steps of: feeding a continuous web 12 having perforated lines 72 to a rotary cutter 40; transversely severing the continuous web 12 along transverse cut lines offset from perforated lines 72 to form multi-page forms 52 having tails 62; advancing forms 52 from rotary cutter 40 to a folding apparatus 86; and, folding forms 52 in folding apparatus 86 along all perforated lines 72 except that one which is adjacent the transverse cut line forming tail 62. The method further provides for the steps of stacking the folded forms 52 so that tails 62 of each folded form 52 extend beyond an edge of stack 64; and, separating or identifying the folded forms 52 from stack 64 by reference to the tails 62 extending from stack 64.

A further aspect of the present invention is a method for advancing and controlling a form 52 or continuous web 12 having a loose leading edge, in which, for simplicity, reference will be made to forms 52, comprising the steps of: advancing a form 52 having a loose leading edge with a pinfeed assembly 26; engaging the leading edge with a hold-down assembly 70 and pull roller 68; directing the leading edge and form 52 through hold-down assembly 70 and pull roller 68, and thence through fixed chute 78, into a pair of outfeed gripper rollers 80; and, gripping the leading edge and the form 52 with outfeed gripper rollers 80 to advance them to folding apparatus 86. The method further preferably provides for imparting a corrugated shape to form 52 in the step of gripping with outfeed gripper rollers 80. As before, the method applies to both forms 52 and continuous web 12.

Finally, in a further aspect of the present invention, an article is provided comprising a folded form 52 of two or more pages having a tail 62 which may be used to identify form 52 in stack 64 or separate form 52 from stack 64.

While certain representative embodiments and details have been shown for purposes of illustrating the invention, it will be apparent to those skilled in the art that various changes in the apparatus, method and article disclosed herein may be made without departing from the scope of the invention, which is defined in the appended claims.

What is claimed is:

1. An apparatus for severing and then folding successive forms of two or more pages from a moving continuous web by transverse severing cuts, each of said forms having a tail which extends from a transverse severing cut to an adjacent perforated line, said tail extending beyond the edge of a stack of folded ones of said web sections, said apparatus comprising:

means for feeding a continuous web in a direction of web movement, said continuous web adapted for folding;

means for severing said continuous web with transverse cuts offset from perforated lines in said web to form separate forms having tails, said means for severing spaced in said direction of web movement from said means for feeding, and said means for severing responsive to indicia on said continuous web to transversely cut said continuous web offset from perforated lines to form said tails;

means for advancing said forms spaced in said direction of web movement from said means for severing;

means for folding said forms spaced in said direction of web movement from said means for advancing; and means for driving said means for feeding, said means for severing, said means for advancing, and said means for folding in timed cooperation;

whereby said continuous web may be severed and successive ones of said forms folded into stacks, said forms having tails which extend beyond an edge of said stacks.

2. An apparatus as recited in claim 1 wherein said means for severing said continuous web comprises a rotary cutter having a rounded tail blade.

3. An apparatus as recited in claim 1 wherein said tail is made by a severing cut at the trailing edge of said form.

4. An apparatus as recited in claim 1 wherein said tail is made by a severing cut at the leading edge of said form.

5. An apparatus as recited in claim 1 further comprises;

means for sensing indicia disposed on said continuous web; and means for controlling said means for severing responsive to said means for sensing indicia.

6. An apparatus as recited in claim 5 wherein said means for controlling said means for severing comprises a clutch/brake engagable with said means for severing responsive to said means for sensing indicia.

7. An apparatus for severing and then folding a series of forms from a moving continuous web by transverse severing cuts, each of said forms having a tail formed between said transverse severing cuts and a perforated line in said continuous web adjacent said transverse severing cuts, each of said tails extending beyond the edge of a stack of folded ones of said forms, said apparatus comprising:

one or more infeed rollers adapted to feed a continuous web in a direction of web movement, said continuous web having perforated lines for folding;

at least one pinfeed assembly adapted to pull and advance said continuous web in said direction of web movement;

a rotary cutter having a rounded tail blade adapted to sever said moving continuous web with transverse cuts into forms, said rotary cutter spaced in said direction of web movement from said one or more infeed rollers;

a hold-down assembly and pull roller adapted to receive said forms from said rotary cutter;

two or more outfeed gripper rolls adapted to receive said forms from said hold-down assembly and pull roller, and advance said forms into a folding apparatus;

a fixed chute disposed to conduct said forms between said hold-down assembly and pull roller, and said two or more outfeed gripper rollers;

means for zig zag folding of said forms;

one or more drive motors;

means for transmitting mechanical power from said one or more drive motors to said one or more infeed rollers, said pull rollers, said outfeed gripper rollers and said means for zig zag folding;

means for transmitting power from said one or more drive motors to a clutch/brake, said clutch/brake engagable with said rotary cutter to make a transverse cut therewith;

means for sensing indicia disposed on said continuous web; and control means interrelated with said means for sensing to engage said clutch/brake with said rotary cutter to make a transverse cut in said continuous web in timed sequence with said indicia, said transverse cut offset from the nearest adjacent perforated line on said continuous web;

whereby said continuous web may be severed and folded into stacks of forms having tails which extend beyond one edge of said stacks.

8. A method for separating and folding successive forms having identifying tails, comprising the steps of:

feeding a continuous web having perforated lines to a rotary cutter;

transversely severing the continuous web along transverse cut lines offset from perforated lines to form forms having tails;

advancing said forms from said rotary cutter to a folding apparatus; and folding each of said forms in said folding apparatus in zig zag fashion along all perforated lines except that one which is adjacent the transverse cut line forming said tail, said tail being sufficiently short that said folding apparatus is unable to perform said step of folding along the perforated line adjacent thereto.

9. A method as recited in claim 8 wherein said step of transversely severing is performed in response to indicia on said continuous web.

10. A method as recited in claim 8 further comprising the steps of:

stacking said folded forms in a stack so that said tail of each folded form extends beyond an edge of said stack; and separating said folded forms from said stack by reference to said tails extending from said forms.

* * * * *